United States Patent [19]

Zaplatynsky

[11] 4,434,189

[45] Feb. 28, 1984

[54] METHOD AND APPARATUS FOR COATING SUBSTRATES USING A LASER

[75] Inventor: Isidor Zaplatynsky, Fairview Park, Ohio

[73] Assignee: The United States of America as represented by the Adminstrator of the National Aeronautics and Space Administration, Washington, D.C.

[21] Appl. No.: 358,398

[22] Filed: Mar. 15, 1982

[51] Int. Cl.[3] ..... B05D 3/06; C23C 13/08; B05B 5/00

[52] U.S. Cl. ..... 427/53.1; 118/50.1; 118/624; 118/641; 427/399

[58] Field of Search ..... 427/53.1, 399; 219/121 L, 121 LE, 121 LF; 118/50.1, 624, 641

[56] References Cited

U.S. PATENT DOCUMENTS

| | | | |
|---|---|---|---|
| 3,947,653 | 3/1976 | Fairbairn | 219/76 |
| 4,122,240 | 10/1978 | Banas et al. | 428/655 |
| 4,157,923 | 6/1979 | Yen et al. | 148/4 |
| 4,212,900 | 7/1980 | Serlin | 427/53.1 |
| 4,260,649 | 4/1981 | Dension et al. | 118/50.1 X |
| 4,277,320 | 7/1981 | Beguwala et al. | 427/53.1 X |
| 4,299,860 | 11/1981 | Schaefer et al. | 427/53.1 |

*Primary Examiner*—Michael R. Lusignan

*Attorney, Agent, or Firm*—Norman T. Musial; John R. Manning; Gene E. Shook

[57] ABSTRACT

Metal substrates, preferably of titanium and titanium alloys, are coated by alloying or forming TiN on a substrate surface. A laser beam strikes the surface of a moving substrate in the presence of purified nitrogen gas. A small area of the substrate surface is quickly heated without melting. This heated area reacts with the nitrogen to form a solid solution. The alloying or formation of TiN occurs by diffusion of nitrogen into the titanium. Only the surface layer of the substrate is heated because of the high power density of the laser beam and short exposure time. The bulk of the substrate is not affected, and melting of the substrate is avoided because it would be detrimental.

10 Claims, 1 Drawing Figure

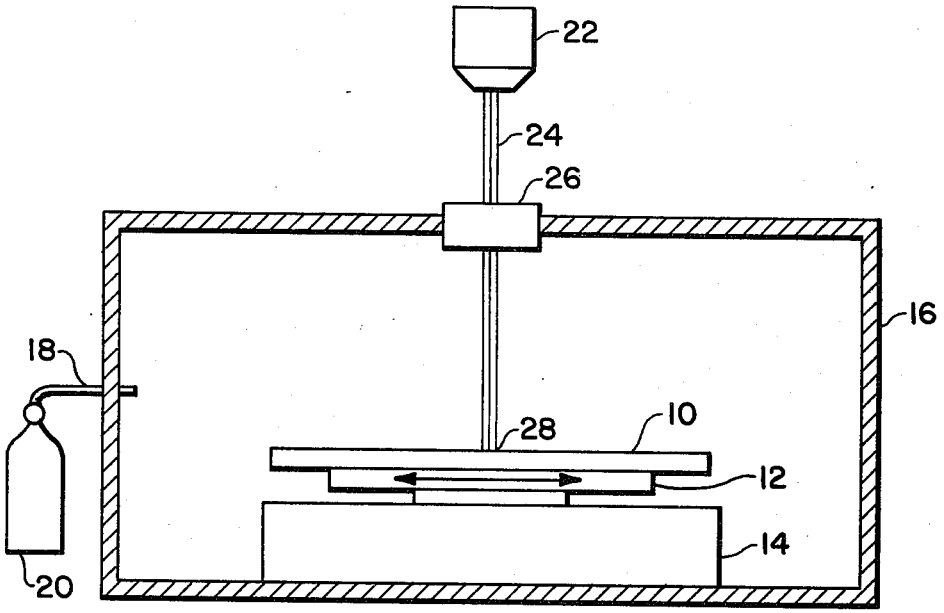
22
24
26
16
18
28
10
12
14
20

METHOD AND APPARATUS FOR COATING SUBSTRATES USING A LASER

ORIGIN OF THE INVENTION

The invention described herein was made by an employee of the United States Government and may be manufactured and used by or for the Government for governmental purposes without the payment of any royalties thereon or therefor.

TECHNICAL FIELD

This invention is concerned with coating metal substrates. It is particularly directed to forming protective coatings on titanium and titanium alloys with the aid of a laser.

Titanium metal and titanium alloys are difficult or nearly impossible to lubricate. A variety of surface treatments have been developed for titanium and its alloys for reducing wear, improving corrosion resistance, or reducing galling tendencies. Such treatments include nitriding, oxidizing, anodizing, surface alloying, metallic and ceramic coatings.

For various reasons the prior art coatings have never been completely satisfactory. In general, some mechanical properties such as fatigue life, ductility, etc. have been negatively affected. The exceptions are ion vapor deposited platinum and aluminum.

Nitrogen is an excellent hardening element in solution in titanium alloys, and diffusion rates are sufficiently low that surface hardening can be quite effectively controlled. The most promising nitriding process involves exposure in a purified nitrogen atmosphere at temperatures between 1500° and 1900° F.

Nitriding is, at the same time, somewhat damaging to fatigue properties. Despite this, nitriding has been used with success for certain applications in hardening gears. In these applications the gears were lapped after nitriding to remove the TiN surface layer. This leaves only the nitrogen hardened solid solution layer which apparently was not very degrading to fatigue life.

The application of lasers to nitriding of titanium and titanium alloys has several advantages. It provides for selective treatment where only certain areas are nitrided without affecting the other surfaces. Cleanliness and cost of operation are lower than with using process involving furnaces.

BACKGROUND ART

Fairbairn U.S. Pat. No. 3,947,653 is concerned with providing a composite laser-RF energy beam to generate high temperatures. The beam is used to form coatings by spraying powders onto workpieces and fusing them.

Banas et al U.S. Pat. No. 4,122,240 is concerned with treating the surface of metal articles by skin melting. A thin surface layer is melted by heating it to a temperature between the melting and vaporization temperatures using a laser as a concentrated energy source. The temperature gradient between the melted and unmelted portion of the article is maximized so that cooling and solidification is extremely rapid when the energy source is removed. This produces unique microstructures.

Yen et al U.S. Pat. No. 4,157,923 is concerned with improving physical properties of a non-allotropic article along a beam affected zone by heat treatment and alloying. A high energy laser beam is passed across the surface area to produce a rapid self-quenching rate which assures a desired precipitate and/or intermetallic compound in the resolidification zone. Alloying is produced in the molten condition.

Serlin U.S. Pat. No. 4,212,900 discloses surface alloying by melting using a laser beam. The alloying material is placed on the substrate surface and a laser beam is directed at it for a predetermined short period of time. The time and beam intensity are cooperatively selected so that the alloying material is melted and alloyed with the substrate.

DISCLOSURE OF INVENTION

This invention is concerned with providing protective coatings on metals. The invention is particularly directed to forming protective coatings on substrates of titanium and titanium alloys by alloying or forming TiN when nitrogen diffuses into the substrate.

In accordance with the invention, a laser beam strikes the surfaces of the moving alloys in the presence of a gas containing an element to be deposited. A small area of the surface is heated producing a "hot spot" which reacts with the element in the gas to form a solid solution. The alloying or formation of TiN occurs by diffusion of nitrogen into the titanium. Melting of the substrate is avoided because it would be detrimental. Spallation would occur if melting was used.

Due to high power density of the laser beam and short exposure time, only the surface layer of the specimen is heated. The bulk of the specimen is not effected. Also, the treatment can be applied to either selected areas of a specimen or only a part of an article.

BRIEF DESCRIPTION OF THE FIGURE

The objects, advantages, and novel features of the invention will be more fully apparent from the following detailed description when read in connection with the accompanying FIGURE which is a vertical sectional view through apparatus for performing the method of the invention.

DETAILED DESCRIPTION OF THE INVENTION

Referring now to the FIGURE there is shown a metal substrate 10 or article which is to be coated in accordance with the invention. By way of example, the substrate 10 is of titanium or a titanium alloy.

The substrate 10 is mounted on a table 12 that is connected to a manipulator 14. The manipulator 14 moves the substrate 10 in a desired manner which is well known in the art as indicated by the arrow. The manipulator 14 together with the substrate 10 are mounted within a suitable vacuum type dry box 16. A gas line 18 enters the dry box 16 and is connected to a suitable source of gas 20. By way of example, the line 18 may be connected to a source of purified nitrogen.

A laser generating apparatus 22 is mounted outside the dry box 16. The apparatus 22 is preferably of the $CO_2$ type which is capable of generating a focused laser beam 24 of infrared radiation of the continuous wave type.

The focussed laser beam 24 passes through a NaCl window 26 in the dry box 16. The window 26 is transparent to infrared radiation.

In a typical operation, a nitrogen pressure of 700 torr is maintained in the dry box 16. A focussed beam 24 of infrared radiation from the $CO_2$ laser generating apparatus 22 has a power density of at least 20,000 W/cm$^2$ and passes through the window 26 into the dry box 16. The laser beam 24 strikes the substrate 10 causing rapid heating of a small area 28 on the substrate surface. The temperature should not exceed 1800° C. which is the melting point of titanium. This "hot spot" reacts with nitrogen from the source 20 forming initially a solid solution.

This solid solution of nitrogen in titanium then forms TiN (titanium nitride) on the surface of the substrate 10. During this process the substrate 10 is moved by the manipulator 14 in a manner such that each element or portion of the surface to be coated is exposed to the laser beam 24. A scanning speed of 20 cm/min has been found to give satisfactory results.

Substrates 10 of titanium and titanium alloys were coated in accordance with the invention, and the TiN coating had a thickness of about 0.3 mils. This coating was identified by X-ray defraction and by its golden color. The TiN coating way very adherent and had no cracks.

It is apparent that a laser beam 24 having a higher power density could be used with a corresponding increase in scanning speed. The limitations on such changes are that no melting of the substrate 10 should occur. Also, the scanning speed must be such that sufficient time for diffusion is provided.

It will be apparent that large substrates 10 may be handled without the necessity of significant investment in equipment. Also, the process may be performed in a high purity ambient environment.

It is contemplated this process can be utilized in nitriding of other alloys in addition to titanium. It is further contemplated that aluminizing, siliciding, chromizing and carbonizing may be performed in accordance with the invention. In these latter embodiments a gas or vapor of a chemical compound containing the element to be deposited is furnished by the supply 20. It is further contemplated that the process may be utilized in the formation of metallic or ceramic coatings on ceramic materials. Various other modifications may be made to the substrate, apparatus, and method without departing from the spirit of the invention or the scope of the subjoined claims.

By way of example, it is contemplated that the laser nitridation runs or passes could be repeated to increase the thickness of the coating. Also, additional surface heat treatment in a vacuum with no nitrogen could be performed in situ. The degree of nitridation can be evaluated by metallographic examination, micro-hardness measurements and chemical analysis.

I claim:

1. A method of forming a protective coating on a substrate of a metal selected from the group consisting of titanium and titanium alloys comprising the steps of positioning said substrate in purified nitrogen gas, focusing a beam of infrared radiation onto a surface of said substrate to rapidly heat a small area on the substrate to a temperature below the melting point of the substrate whereby said nitrogen reacts with the heated titanium in said small area to form initially a solid solution which subsequently forms titanium nitride without melting, and moving said small area along the surface of said substrate to coat the same.

2. A method of forming protective coatings as claimed in claim 1 wherein the small area on the surface of the substrate is heated to a temperature not exceeding 1800° C. with a focused beam of infrared radiation.

3. A method of forming protective coatings as claimed in claim 2 wherein the substrate surface is heated with a $CO_2$ laser beam having a power density of at least 20,000 W/cm$^2$.

4. A method of forming protective coatings as claimed in claim 3 wherein the substrate is moved relative to said laser beam so that each portion of the surface to be coated is heated by said beam.

5. A method of forming protective coatings as claimed in claim 4 wherein the substrate is moved so that the scanning speed of the laser beam is about 20 cm/min.

6. A method of forming protective coatings as claimed in claim 5 including repeating the scanning by the laser beam to increase the thickness of the coating.

7. Apparatus for forming a protective coating on a substrate of a metal selected from the group consisting of titanium and titanium alloys comprising a vacuum tight chamber, a source of purified nitrogen in communication with the interior of said chamber, laser generating apparatus mounted outside said chamber for generating a focused laser beam, means in a wall of said chamber for enabling said laser beam to pass therethrough to the interior of said chamber, means for mounting said substrate within said chamber with a surface thereof to be coated being angularly disposed to said laser beam so that said laser beam strikes a small surface area thereof to heat the same to a temperature below the melting point of the substrate whereby said nitrogen reacts with the heated titanium in said small area to form initially a solid solution which subsequently forms titanium nitride without melting, and means for moving said substrate relative to said laser beam so that each portion of the surface to be coated is struck and heated by said beam.

8. Apparatus for forming a protective coating on a substrate as claimed in claim 7 wherein the laser generating apparatus is of a $CO_2$ type having a power density of at least 20,000 W/cm$^2$.

9. Apparatus for forming a protective coating on a substrate as claimed in claim 8 including a NaCl window in the wall of the chamber for transmitting the laser beam from the source to the substrate.

10. Apparatus for forming a protective coating on a substrate as claimed in claim 9 including means for scanning the surface of the substrate with the laser beam at a speed of about 20 cm/min.

* * * * *